US010362864B2

(12) United States Patent
Walker

(10) Patent No.: US 10,362,864 B2
(45) Date of Patent: Jul. 30, 2019

(54) CONVERTIBLE LED TABLE TRAY

(71) Applicant: Kimberly Renee Walker, Sicklerville, NJ (US)

(72) Inventor: Kimberly Renee Walker, Sicklerville, NJ (US)

( * ) Notice: Subject to any disclaimer, the term of this patent is extended or adjusted under 35 U.S.C. 154(b) by 60 days.

(21) Appl. No.: 15/650,745

(22) Filed: Jul. 14, 2017

(65) Prior Publication Data

US 2017/0311712 A1 Nov. 2, 2017

Related U.S. Application Data

(60) Provisional application No. 62/362,552, filed on Jul. 14, 2016.

(51) Int. Cl.

| | |
|---|---|
| ***A47B 85/00*** | (2006.01) |
| ***A47B 31/04*** | (2006.01) |
| ***A47B 31/00*** | (2006.01) |
| ***A47B 13/08*** | (2006.01) |
| ***A47B 5/02*** | (2006.01) |
| ***A47G 23/03*** | (2006.01) |
| ***A47G 23/06*** | (2006.01) |
| *A47B 5/00* | (2006.01) |
| *A47B 13/00* | (2006.01) |

(52) U.S. Cl.

CPC ..... *A47B 31/04* (2013.01); *A47B 5/02* (2013.01); *A47B 13/08* (2013.01); *A47B 31/00* (2013.01); *A47G 23/0303* (2013.01); *A47G 23/06* (2013.01); *A47B 5/00* (2013.01); *A47B 13/00* (2013.01); *A47G 2200/08* (2013.01)

(58) Field of Classification Search

CPC .. A47B 31/04; A47B 5/00; A47B 5/02; A47B 13/08; A47G 23/0303; A47G 23/06; A47G 2200/08; A47G 23/0608

See application file for complete search history.

(56) References Cited

U.S. PATENT DOCUMENTS

| | | | | | |
|---|---|---|---|---|---|
| 2,944,694 | A * | 7/1960 | Kinsey | A47G 23/06 | 206/499 |
| 3,610,459 | A * | 10/1971 | Hanson | A47G 19/10 | 206/818 |
| 3,685,687 | A * | 8/1972 | Eckdahl | A47G 23/06 | 206/504 |
| 4,083,453 | A * | 4/1978 | Berger | A47G 23/06 | 206/564 |
| 5,377,946 | A * | 1/1995 | Pannu | A47B 23/002 | 248/456 |
| 2004/0084463 | A1* | 5/2004 | Belasalma | A47G 23/06 | 220/756 |
| 2014/0110413 | A1* | 4/2014 | Kelly | A47G 23/06 | 220/560 |

* cited by examiner

*Primary Examiner* — Matthew W Ing

(74) *Attorney, Agent, or Firm* — Changi Wu; Changi Wu Law Office

(57) ABSTRACT

A convertible LED table tray comprising a central compartment, wherein the central compartment further comprises a upper deck; a drawer movable relatively in and out the central compartment; a first side compartment connected to the central compartment; a second side compartment opposed to the first side compartment connected to the central compartment; at least one light-emitting diode light on the upper deck; a charger plates; and a means for holding the charger plates on the upper deck of the central compartment.

14 Claims, 5 Drawing Sheets

CONVERTIBLE LED TABLE TRAY

CROSS-REFERENCE RELATED TO RELATED APPLICATIONS

This application claims the benefit and priority of U.S. Provisional Application No. 62/362,552, filed Jul. 14, 2016, which is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

As is known, place mats have been the preferred method to create the informal table settings, for example, in homes, restaurants, and similar establishments. Generally, the traditional methods used for table decor are table mats made of woven, vinyl and plastic material and typically sized to hold plates Setting a traditional table can be challenging, as table setting guidelines for etiquette are a bit rigid using measurements as a tool for exact placement, and a bit of expertise is helpful to know where to place the desert fork & spoon, soup spoon, dinner knife, dinner fork and spoon, salad fork, and bread Plate. Typically, individualized place mats do not protect the flatware from airborne particles due to their open design. Typically, Charger plates are decorative and aren't included with table mats. The Charger Plates are attached to the Tray to prevents spills to the tray, and detaches for easy clean up.

BRIEF SUMMARY

This Brief Summary is included so as to introduce, in an abbreviated form, various topics to be elaborated upon below in the Detailed Description. This Brief Summary is not intended to identify key or essential aspects of the claimed invention. This brief Summary is similarly not intended for use as an aid in determining the scope of the claims.

The present invention relates a convertible Light-Emitting Diode (LED) table tray comprising a central compartment, wherein the central compartment further comprises a upper deck; a drawer movable relatively in and out the central compartment; a first side compartment connected to the central compartment; a second side compartment opposed to the first side compartment connected to the central compartment; at least one light-emitting diode light on the upper deck;

a charger plates; and a means for holding the charger plates on the upper deck of the central compartment. The convertible LED table tray makes it easy for a beginner to decorate an elegant table effortlessly by using the engraved outlines on the Trays. In restaurant settings clean-up after meals will be effortlessly due the retractable device intended for utensils and plates. The Charger Plates are attached to the Tray to prevents spills to the tray, and detaches for easy clean up. The new design provides uniformity, keeping in mind the traditions and values essential to decorating an elegant table effortlessly. The invention is aesthetically pleasing as well as functional for daily use.

BRIEF DESCRIPTION OF THE DRAWINGS

It should be understood that the drawings are merely representative, are not necessarily drawn to scale, and are not intended to limit the subject matter of this application.

DETAILED DESCRIPTION

Figure 1:
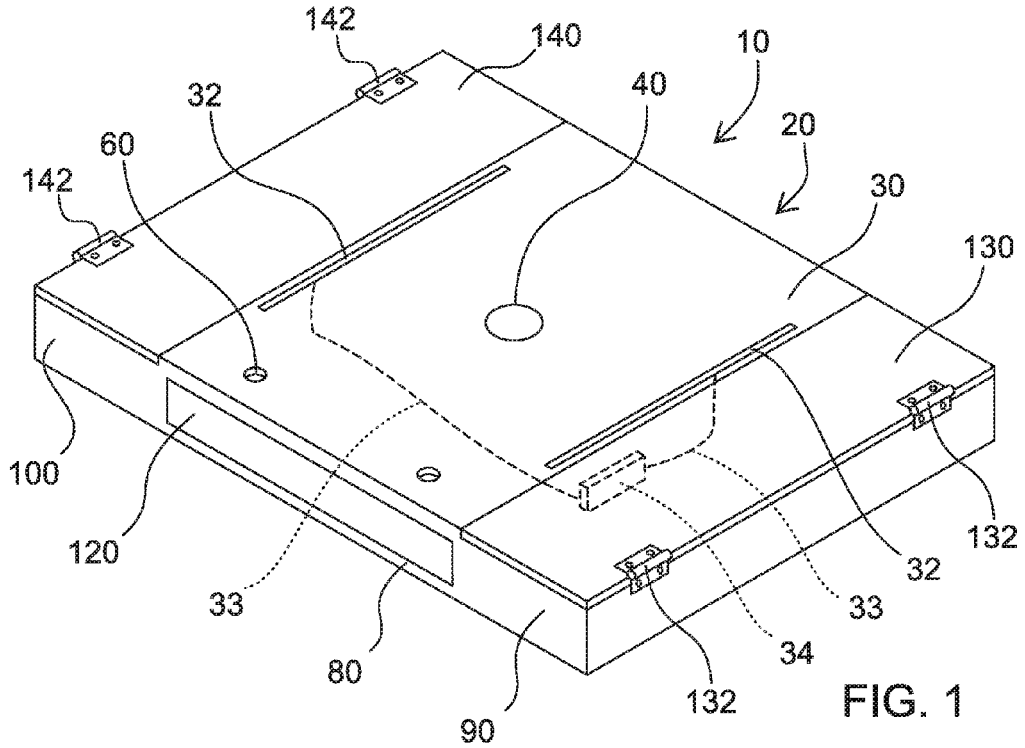
FIG. 1 is perspective view of one of the preferred embodiment of the invention when the first side cover and second side cover are closed.
Figure 2:
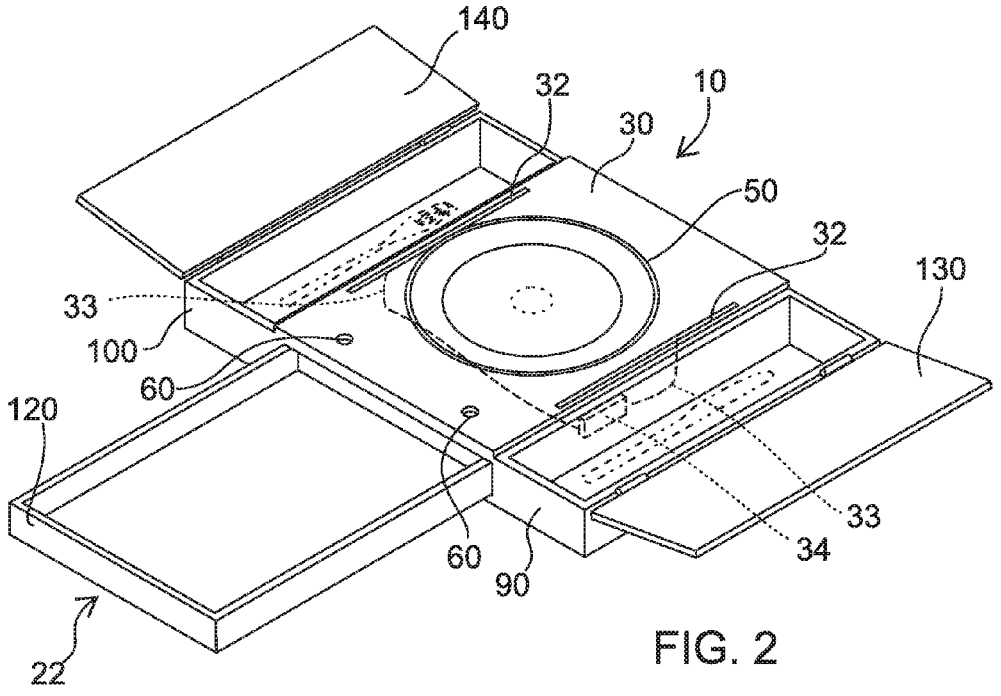
FIG. 2 is perspective view of one of the preferred embodiment of the invention when the first side cover and second side cover are open.
Figure 3:
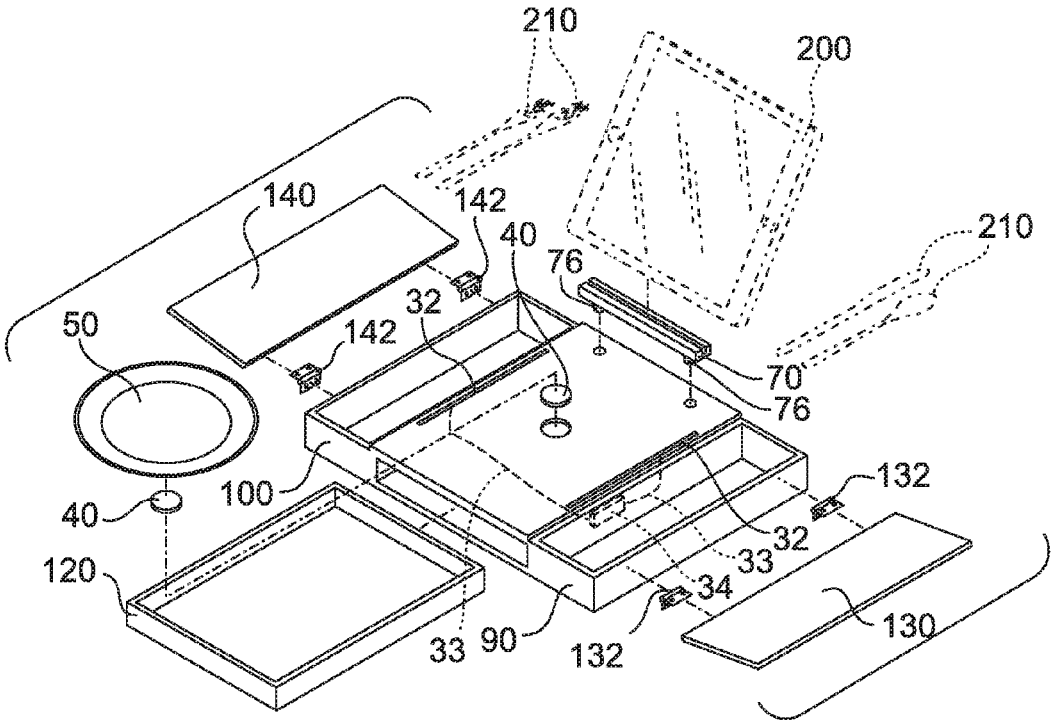
FIG. 3 is an exploded view of one of the preferred embodiment of the invention.
Figure 4:
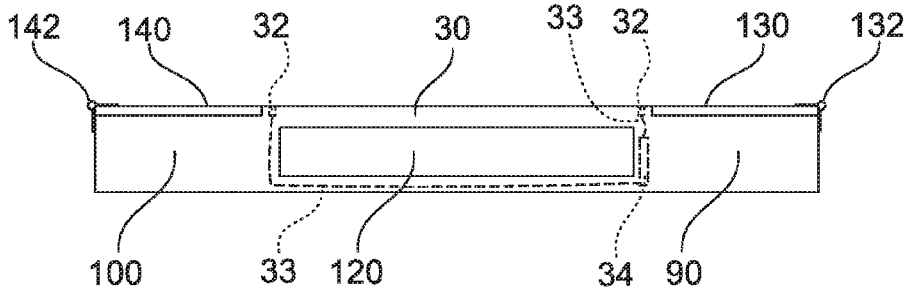
FIG. 4 is a front view of one of the preferred embodiment of the invention when the first side cover and second side cover are closed.
Figure 5:
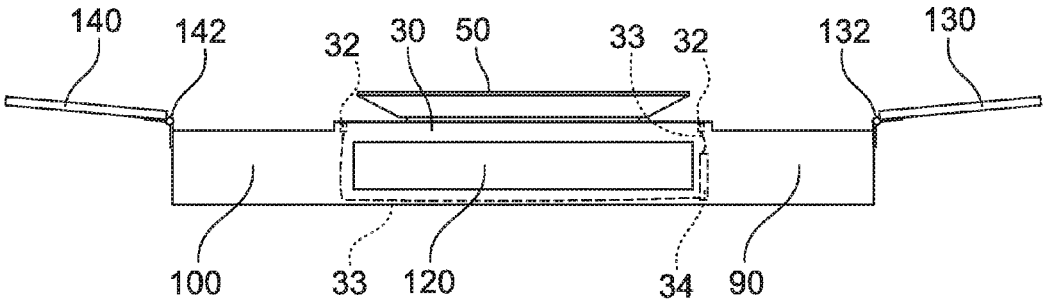
FIG. 5 is a front view of one of the preferred embodiment of the invention when the first side cover and second side cover are open.
Figure 6:
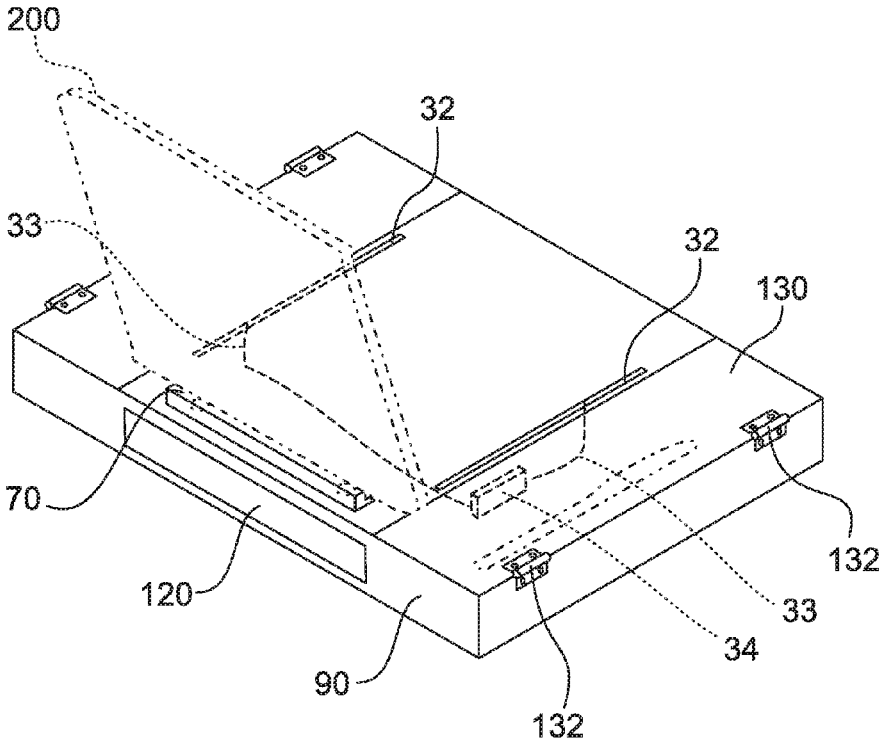
FIG. 6 is a perspective view of one of the preferred embodiment of the invention when an electronic device is on the electronic holder.
Figure 7:
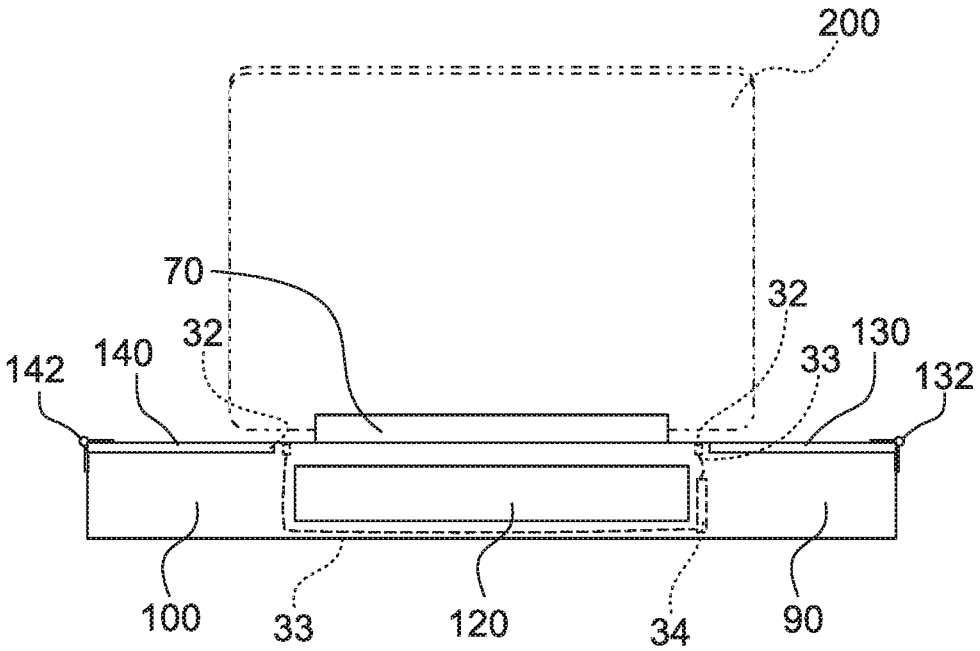
FIG. 7 is a front view of one of the preferred embodiment of the invention when an electronic device is on the electronic holder.
Figure 8:
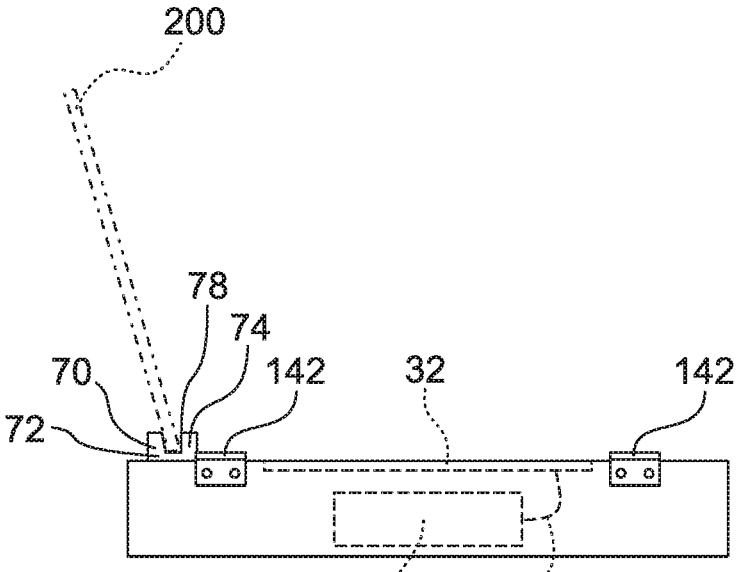
FIG. 8 is a side view of one of the preferred embodiment of the invention when an electronic device is on the electronic holder.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Referring to FIG. 1, FIG. 2, FIG. 3, FIG. 4, and FIG. 5 one preferred embodiment of the present invention directing to a convertible LED table tray 10, comprises a central compartment 20, wherein the central compartment 20 comprises a upper deck 30; a drawer 120 movable relatively in and out the central compartment 20; a first side compartment 90 connected to the central compartment 20; a second side compartment 100 opposed to the first side compartment 90 connected to the central compartment 30; and a means 40 for holding objects on the upper deck 30 of the central compartment 20. The means 40 for holding objects on the upper deck 30 can include such as magnets attached on the upper deck and on the objects, hook and loop fastener attached on the upper deck and on the objects, quick-release buckle attached on the upper deck and on the objects, quick-release mount attached on the upper deck and on the objects, and quick-release adapter attached on the upper deck and on the objects, so that the objects, such as charger plate 50 or other ornaments, can be hold on the upper deck to prevent from tipping over or flipping over, but remain easy to be released from the upper deck 30. In one preferred embodiment, the upper deck 30 is installed with a set of LED lights 32 for illumination purpose. The LED light 32 is battery-powered. Wires 33 and battery sets 34 can be configured to be inside the central compartment. The illuminating means can also be other ways, such as photoluminescent strips, halogen lights, or polymer light-emitting diodes.

Referring to FIG. 1, FIG. 2, FIG. 3, FIG. 4, and FIG. 5, one preferred embodiment of the present invention directing to a convertible LED table tray 10, wherein the first side compartment 90 further comprises an first open top, a first movable cover 130, hinges 132 for joining the first movable cover with the first side compartment; and wherein the second side compartment 100 further comprises an second open top, a second movable cover 140, and hinges for joining the second movable cover with the second side compartment. as a means for joining the first movable cover with the first side compartment 142. The hinges 132 can be other means such as universal joint, ball joint, latches, or mechanical linkage. The first movable cover 130 and second movable cover 140 can be folded inwardly to cover the first side compartment 90 and the second side compartment 100. The first side compartment 90 and second side compartment 100 can store flatware.

Referring to FIG. 1, FIG. 2, FIG. 3, FIG. 4, FIG. 6, FIG. 7, one preferred embodiment of the present invention is directed to a convertible LED table tray 10, comprises an electronic device holder 70, wherein the electronic device holder 70 further comprises a body 72, a base 74, and a plurality of magnets 76 for attaching the electronic device holder 70 to the upper deck 30 of the central compartment 20, and wherein a slot 78 configured to hold at least one electronic device 200 is formed longitudinal through the body 72. The plurality of magnets 70 is sized to fit into a plurality of holes 60. The plurality of magnets 76 for attaching the electronic holder can be also as plugs or configured to fit into the plurality of holes 60. The size of magnet and plugs is configured to fit into the holes 60 so that increases the stability of the electronic device holder 70. The electronic device holder can use to hold a tablet or similar electronic devices.

Referring to FIG. 3, FIG. 6, FIG. 7, and FIG. 8, one of the embodiment of the invention shows at least one charger plate 50 having at least one magnet 40 attached on the bottom to work with the magnet 40 on the upper deck 30 so that the charger plate can be hold or secured on the upper deck 30. The means for attaching the charger plate to the upper deck can also be a plurality of hoop and loop fasteners that works together with a plurality of hoop and loop fasteners attached on the upper deck.

Figure 9:
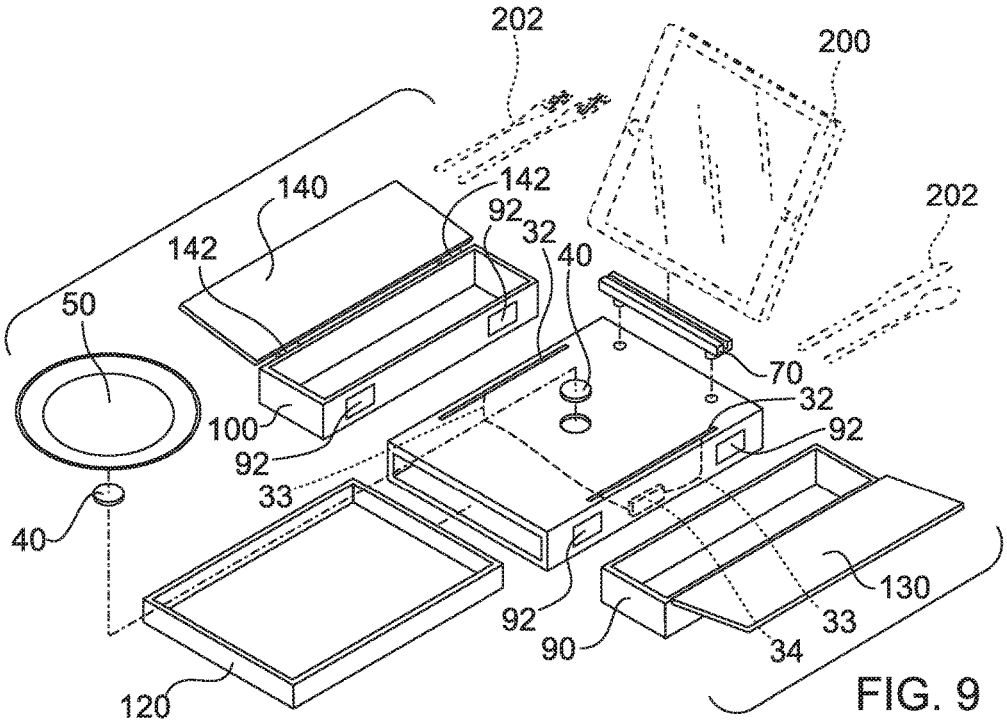
FIG. 9 is an exploded view of one of the preferred embodiment of the invention when first side compartment and second side compartment are detached from the central compartment.
Figure 10:
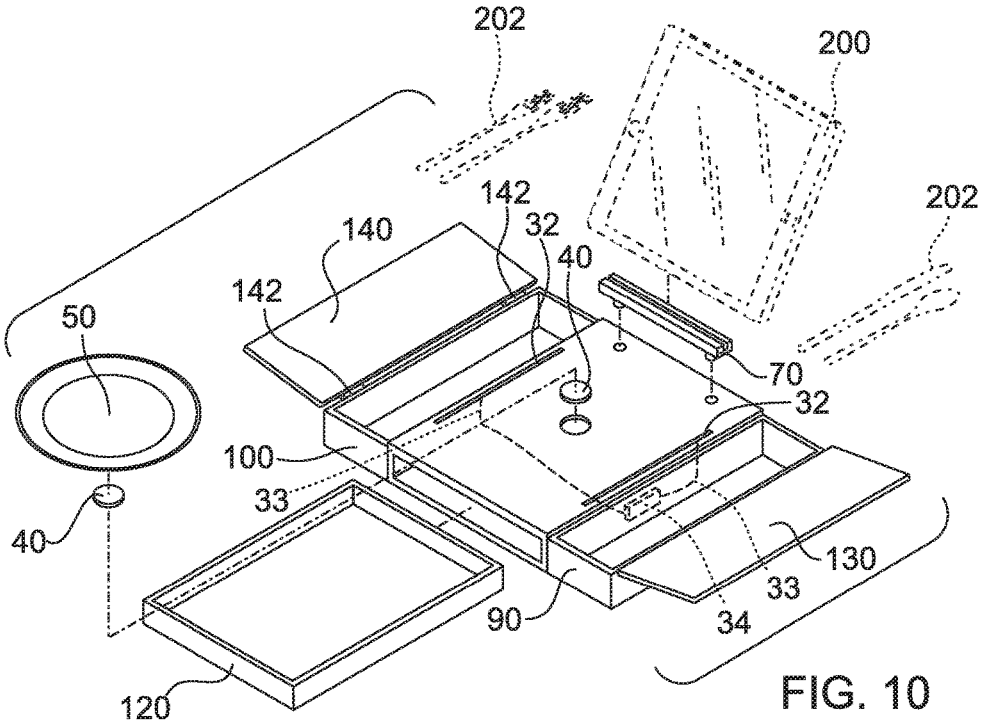
FIG. 10 is an exploded view of one of the preferred embodiment of the invention when first side compartment and second side compartment are detachable but are currently attached with the central compartment.

Referring to FIG. 9 and FIG. 10, one of the embodiment of the invention shows that the first side compartment and the second side compartment are detachable from the central compartment. The means for joining the first side compartment and the second side compartment with the central compartment include magnets 92 on the first side compartment, the second side compartment, and the central compartment. The magnets 90 may be varied as magnet on the central compartment and other magnetic material on the first side compartment and the second compartment. The means for joining may also be loop and hook fasteners, sticky materials, or quick lock. In one embodiment of the materials for the convertible LED table tray 10 are such as metal, plastics, woods, stone, laminate, quartz, marble, but preferably made of laminate, quartz, wood, or marble. The dinnerware 202 such as folks and spoons or others can be stored in the first or second side compartments.

Giving options to decorate a table elegantly and effortlessly, the convertible LED table tray is versatile, allowing china and flatware to be stored until ready for use. Unlike most table mats, which are disposable, made of cloth, and require replacement, the convertible LED table trays can be cleaned and kept for long term usage. When school lunch and cafeteria food trays are not atheistically attractive for setting tables and hospitals trays contains partitions for food, the convertible LED table tray offers multiple functions for storage, table setting display, and decoration.

It is understood that the description herein is an exemplary indication of a preferred embodiment of the invention, and is given by way of illustration only. While the some embodiments have been described in detail and with reference to specific examples, thereof, it will be apparent to one skilled in the art that various changes and medications can be made therein without departing from the spirit and scope thereof.

What is claimed:

1. A convertible LED table tray, comprising:

a central compartment, wherein the central compartment further comprises a upper deck;

a drawer movable relatively in and out the central compartment;

a first side compartment connected to the central compartment;

a second side compartment opposed to the first side compartment connected to the central compartment;

at least one light-emitting diode light on the upper deck;

a charger plate;

a means for holding the charger plate on the upper deck of the central compartment; and a means for joining the first side compartment and the second side compartment with the central compartment, and wherein the first side compartment and the second side compartment are detachable from the central compartment.

2. The convertible LED table tray of claim 1, wherein the first side compartment further comprises an first open top, a first movable cover, a means for joining the first movable cover with the first side compartment; and wherein the second side compartment further comprises an second open top, a second movable cover, and a means for joining the second movable cover with the second side compartment.

3. The convertible LED table tray of claim 1, further comprising:

an electronic device holder, wherein the electronic device holder further comprises a body, a base, and a means for attaching the electronic device holder to the upper deck of the central compartment, and wherein a slot configured to hold at least one electronic device is formed longitudinal through the body; and wherein a plurality of holes formed on the upper deck 30.

4. The convertible LED table tray of claim 1, further comprises a plurality of magnets for attaching the charger plate to the upper deck.

5. The convertible LED table tray of claim 1, further comprising a means for joining the first side compartment and the second side compartment with the central compartment, and wherein the first side compartment and the second side compartment are detachable from the central compartment.

6. A convertible LED table tray, comprising:

a central compartment, wherein the central compartment further comprises a upper deck;

a drawer movable relatively in and out the central compartment;

a first side compartment connected to the central compartment;

a second side compartment opposed to the first side compartment connected to the central compartment;

a means for joining the first side compartment and the second side compartment with the central compartment, and wherein the first side compartment and the second side compartment are detachable from the central compartment;

an electronic device holder, wherein the electronic device holder further comprises a body, a base, and a means for attaching the electronic device holder to the upper deck of the central compartment, and wherein a slot configured to hold at least one electronic device is formed longitudinal through the body;

a charger plate;

a means for attaching the charger plate to the upper deck;

at least one light-emitting diode light on the upper deck;

wherein the first side compartment further comprises an first open top, a first movable cover, a means for joining the first movable cover with the first side compartment; and wherein the second side compartment further comprises an second open top, a second movable cover, and a means for joining the second movable cover with the second side compartment.

7. The convertible LED table tray of claim 6, further comprising a means for joining the first side compartment and the second side compartment with the central compartment, and wherein the first side compartment and the second side compartment are detachable from the central compartment.

8. The convertible LED table tray of claim 6, further comprising a plurality of magnets attached to the first side compartment and the second side compartment with the central compartment for joining the first side compartment and the second side compartment with the central compartment.

9. The convertible LED table tray of claim 6, further comprising a plurality of magnets attached to the first side compartment and the second side compartment, and a plurality of magnetic materials attached with the central compartment for joining the first side compartment and the second side compartment with the central compartment.

10. The convertible LED table tray of claim 6, further comprising a plurality of hoop and loop fasteners attached to the first side compartment and the second side compartment with the central compartment for joining the first side compartment and the second side compartment with the central compartment.

11. A convertible LED table tray, comprising:

a central compartment, wherein the central compartment further comprises a upper deck;

a drawer movable relatively in and out the central compartment;

a first side compartment connected to the central compartment;

a second side compartment opposed to the first side compartment connected to the central compartment;

an electronic device holder, wherein the electronic device holder further comprises a body, a base, and at least one magnet attached under the base, and wherein a slot configured to hold at least one electronic device is formed longitudinal through the body;

a charger plate;

a plurality of magnets attached on the upper deck of the central compartment;

at least a means for illuminating on the upper deck; and wherein the first side compartment further comprises an first open top, a first movable cover, a hinge to join the first movable cover with the first side compartment; and wherein the second side compartment further comprises an second open top, a second movable cover, and a hinge to join the second movable cover with the second side compartment; wherein further comprises a means for joining the first side compartment and the second side compartment with the central compartment, and wherein the first side compartment and the second side compartment are detachable from the central compartment.

12. The convertible LED table tray of claim 11, wherein the means for joining the first side compartment and the second side compartment with the central compartment comprises a plurality of magnets attached to the first side compartment and the second side compartment with the central compartment.

13. The convertible LED table tray of claim 11, wherein the means for joining the first side compartment and the second side compartment with the central compartment comprises a plurality of magnet and a plurality of magnetic materials attached to the first side compartment and the second side compartment with the central compartment.

14. The convertible LED table tray of claim 11, wherein the means for joining the first side compartment and the second side compartment with the central compartment comprises a plurality of loop and hoop fasteners attached to the first side compartment and the second side compartment with the central compartment.

* * * * *